US008709546B2

(12) United States Patent
Zhou et al.

(10) Patent No.: US 8,709,546 B2
(45) Date of Patent: Apr. 29, 2014

(54) PHOTOGRAPHIC PRINTING PAPER AND METHOD OF MAKING SAME

(75) Inventors: Xiaoqi Zhou, San Diego, CA (US); Tao Chen, San Diego, CA (US); Silke Courtenay, San Diego, CA (US); Eric L. Burch, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/525,084

(22) Filed: Jun. 15, 2012

(65) Prior Publication Data

US 2012/0251717 A1 Oct. 4, 2012

Related U.S. Application Data

(62) Division of application No. 11/377,511, filed on Mar. 15, 2006, now abandoned.

(51) Int. Cl.
*B05D 1/36* (2006.01)

(52) U.S. Cl.
USPC ..... 427/411; 427/355; 427/358; 427/361; 427/419.5

(58) Field of Classification Search
USPC ..... 428/32.21; 427/355, 356, 358, 359, 427/361–364, 411, 419.5
See application file for complete search history.

(56) References Cited

U.S. PATENT DOCUMENTS

| | | | | |
|---|---|---|---|---|
| 4,272,569 | A * | 6/1981 | Shaw et al. | 427/336 |
| 4,645,736 | A * | 2/1987 | Anthonsen et al. | 430/538 |
| 2002/0182376 | A1 * | 12/2002 | Mukherjee et al. | 428/195 |

* cited by examiner

*Primary Examiner* — Gerard Higgins

(57) ABSTRACT

A non-absorbing barrier layer for photographic printing paper includes a non-polyolefin resin. A photographic printing paper includes a base substrate; a image receiving layer and a barrier layer comprising a non-polyolefin resin coated on the base substrate. A method of making a photographic printing paper includes coating a barrier layer comprising a non-polyolefin resin on a base substrate. Another method of making a photographic printing paper includes forming a barrier layer on a base substrate using reactive monomers.

12 Claims, 5 Drawing Sheets

PHOTOGRAPHIC PRINTING PAPER AND METHOD OF MAKING SAME

The present application is a divisional application and claims the priority under 35 U.S.C. §120 of previous U.S. patent application Ser. No. 11/377,511 filed Mar. 15, 2006 now abandoned by Xiaoqi Zhou et al. for "Photographic Printing Paper and Method of the Same," the disclosure of which is incorporated herein by reference.

BACKGROUND

Traditionally, the field of photography has involved the exposure of a light-sensitive film to an image focused on the film through a lens. The film is made using silver halide, which forms a latent image in response to the exposure. The image is then developed using a chemical process and printed on photographic paper. Typically, the development of such photographic images is a professional service that photographers pay for each time a new roll of film is to be developed.

More recently, digital cameras, personal computers, and printers have become a viable alternative to traditional silver halide photography. Today, images are captured with a digital camera, transferred electronically to a computer with a printer, or directly to a printer, and then produced by the printer in hardcopy form. Color inkjet printing is often used for printing photographs. This process is something that any amateur photographer can do at home without needing the services of a professional film developer.

An inkjet printer can print a color photograph on a variety of print media, including ordinary paper. However, the resulting quality and durability of such an image printed on ordinary paper is significantly inferior to traditional photographs. For example, the ink used in an inkjet printer typically includes a colorant that is dissolved or suspended in an aqueous carrier fluid that serves as a vehicle for the colorant. With the quantity of ink dispensed to produce a high-quality color photograph, this carrier fluid may significantly wet the paper resulting in cockling or curling of the paper and a requiring a significant drying time.

Thus, it becomes apparent that the image quality and durability of photographic images printed using inkjet technology is strongly dependent on the construction of the print media used. Consequently, improved print media specifically for producing hardcopy photographs has been developed for use in inkjet printers. These various types of print media are referred to generally as photographic printing paper.

SUMMARY

A non-absorbing barrier layer for photographic printing paper includes a non-polyolefin resin. A photographic printing paper includes a base substrate; pigmented sub-coating layers; a barrier layer comprising a non-polyolefin resin, image receiving layers; and back supporting layers. A method of making a photographic printing paper includes coating a barrier layer comprising a non-polyolefin resin on a base substrate without using extrusion coating. Another method of making a photographic printing paper includes forming a barrier layer on a base substrate using reactive monomers.

BRIEF DESCRIPTION OF THE DRAWINGS

The accompanying drawings illustrate various examples of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1:
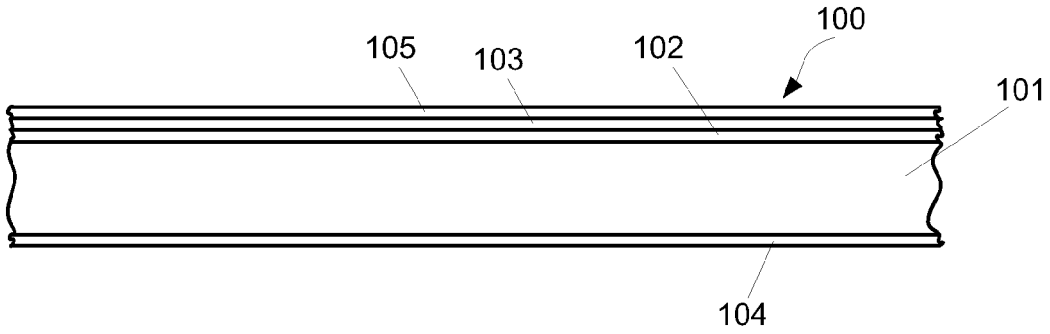
FIG. 1 illustrates a section of a photographic printing paper according to principles described herein.

The present specification describes a high-quality photographic printing paper including a base substrate or paper coated with a pigmented pre-coating or layers, a barrier layer, an image-receiving layer, and optional back support layers. According to one exemplary embodiment, the barrier layer may be a non-polyolefin coating.

The present specification also describes economical methods for making such photographic printing paper using non-extrusion processing. The resulting photographic printing paper has a very high gloss appearance and excellent surface smoothness at low cost. Moreover, the resulting photographic printing paper provides excellent image quality when used to reproduce photographs.

Conventionally, photographic printing paper includes a cellulose base substrate that is substantially thicker than ordinary paper, the surface of which is prepared with an ink-receiving composition. To achieve good image quality, the surface of the photo base stock will exhibit a high level of smoothness and glossiness. Further, it is highly desirable that the surface of the photo base stock have a very low water permeability and is not water swellable, in order to prevent the aqueous vehicle and colorants of an ink composition from migrating into the cellulose base, thereby causing curling and poor gamut problems. In popular examples, cellulose paper is extrusion coated with a polyolefin resin on both sides to serve as barrier layers. Examples of polyolefin resins including high density polyethylene (HDPE), low density polyethylene (LDPE), polypropylene (PP), polymethyl pentene (PMP), and copolymers of ethylene with hexane, butane, and octane (linear low density polyethylene, LLDPE). The polyolefin resins can also be blends of these polymeric materials, such as HDPE/LDPE, LDPE/LLDPE, PP/LDPE, PP/LLDPE. The extrusion coating process involves preparing a molten polyolefin resin and extruding the resin to coat both sides of the base paper by means of, for example, a single or multi-layer extrusion die. The smoothness of the surface is controlled by both roughness of the chilling roll where polyolefin resins were cast, the amount of resin applied, and the base paper quality. To achieve a base of acceptable quality, an amount of 20-30 gsm of resin per side is extruded. The resin materials and coating method are a large portion of product cost for conventional photographic printing paper. The extrusion process is further explained in U.S. Pat. No. 5,104,722 to Kojima et al., which is incorporated herein by reference in its entirety.

As noted above, the Kojima patent describes a photo base paper that is coated with a polyolefin resin layer on both sides through an extrusion process. Additionally, U.S. Pat. No. 5,326,624 to Tsubaki et al. describes the influence of polyolefin resin thickness on over-all performance. U.S. Pat. No. 5,168,034 to Tamagawa et al. describes using polyolefin coatings to obtain a good water-resistant photographic printing paper. U.S. Pat. No. 5,820,977 to Shriakura et al. describes loading pre-treated titanium dioxide with a silane into the polyolefin formulation to increase image sharpness. U.S. Pat. No. 6,190,781 to Tsubaki et al. describes a method of extruding polyethylene on one side of a base substrate and other polyolefins on the other side of the base substrate to obtain superior gloss and curling performance. Each of these patents is incorporated herein by reference in their respective entireties.

However, this traditional process for producing polyolefin-coated paper is relatively expensive and time-consuming. Particularly, the complexities of the extrusion processing and the associated manufacturing costs have some disadvantages economically. A polyolefin, such as polyethylene, is a crystalline polymer which requires the elevated temperatures and the relatively-slow speed of an extrusion process to produce a satisfactory coating. The optimum gloss and stability characteristics are achieved when the coating reaches a certain weight/thickness, i.e., over 25 grams/meter$^2$. Depositing this quantity of coating further increases the cost and decreases manufacture efficiency. Thus, when polyethylene extruded photographic printing paper is produced, the coating processing must be very closely managed.

Moreover, it may be difficult to use polyolefin resins such as polyethylene-coated papers in subsequent high-temperature manufacturing operations. Polyethylene is a flexible thermoplastic resin that can be melted or damaged if exposed to significant temperatures after the photographic printing paper has been produced, such as in subsequent manufacturing processes in which additional coating layers must be heat-dried. Most polyolefin materials also tend to have low surface energy. This inherent nature may generate wetting and adhesion issues for any image receiving layers which are applied on top of it. Consequently, a post-treatment of polyolefin coating layers is performed by corona treatment or by the application of a layer of "adhesion promoter" such as gelatin.

As an alternative, clay-cast coated papers have been developed for use as photographic printing paper. Clay-cast coating for photographic printing paper is further described in U.S. Pat. No. 6,482,581 to Grovers et al., which is incorporated herein by reference in its entirety. The cost of clay-cast coated papers is generally lower than polyethylene extrusion-coated paper. The clay-cast coated paper, however, tends to absorb the aqueous carrier fluid of the ink which may lead to curling of the paper's edges and cockling of the paper's surface. Furthermore, it is difficult to achieve the desired surface conditions such as smoothness and gloss using a clay-cast coating method.

In addition to the disclosure of Grovers, U.S. Patent Application Publication No. 2005/0032644 to Brelsford et al. teaches a coating for a photographic printing paper that is made of inorganic pigments and an acrylic binder. Similarly, U.S. Patent Application Publication No. 2005/0031805 to Fugitt et al. disclosed a photographic printing paper using aragonite calcium carbonate and plastic pigment as the coating on the paper stock. U.S. Pat. No. 6,866,904 to Schoeller describes an inkjet printing substrate which includes a support and a heat-activated polymer layer which is made of polyethylene oxide. U.S. Pat. No. 6,610,388 to Xing et al. describes an inkjet recording media including a paper substrate coated on one side with a radiation curable composition. Each of these patents and patent application publications is incorporated herein by reference in their respective entireties.

The present specification describes a photographic printing paper that is easier and less expensive to manufacture. The photographic printing paper disclosed herein is made from a base substrate or paper that is coated with various layers of material so as to provide such advantages as low cost, glossy appearance, surface smoothness and excellent image quality when used to reproduce photographs, particularly in an inkjet printing system. The present specification will also describe economical methods for making such photographic printing paper, particularly using non-extrusion processing.

FIG. 1 illustrates a first example of photographic printing paper (100) prepared according to principles described herein. As will be appreciated by those skilled in the art, FIG. 1 and the other figures of the application illustrate the relative positioning of the various layers of the photographic printing paper (100) without necessarily illustrating the relative thicknesses of the various layers.

As shown in FIG. 1, the photographic printing paper (100) includes a base substrate (101) which may be, for example, a cellulose paper substrate. Disposed or coated on the base substrate (101) are a back support layer or layers (104), a pigmented pre-coating (102), a barrier layer (103) and an image-receiving layer (105). The barrier layer (103) is, for example, formed using a non-polyolefin resin and provides the paper (100) with high gloss, smoothness, and water-resistance. Each of these various layers, their function and composition, will be described in detail below.

Figure 2:
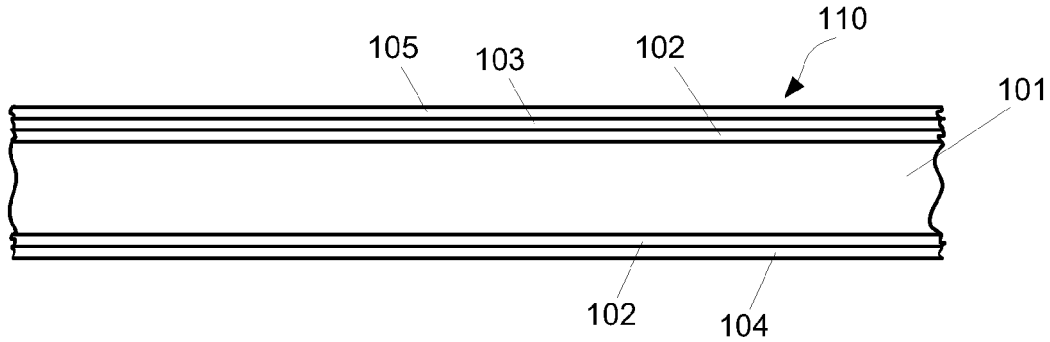
FIG. 2 illustrates a second photographic printing paper according to principles described herein.

FIG. 2 illustrates a second example of photographic printing paper (110) prepared according to principles described herein. As shown in FIG. 2, the photographic printing paper (110) again includes a base substrate (101), barrier layer (103), image-receiving layer (105) and back support layer (104). However, as shown in FIG. 2, the pigmented pre-coating (102) is provided on both sides of the base substrate (101).

The following discussion of the various layers mentioned above will be understood to apply to example of either FIG. 1 or FIG. 2, as well as other embodiments of the principles described herein.

Any kind of cellulose paper stock may be used as the base substrate (101). The base substrate (101) can be made of any suitable wood or non-wood pulp. Non-limitative examples of suitable pulps include mechanical wood pulp, chemically ground pulp, chemi-mechanical pulp, and/or mixtures. Preferably, bleached hardwood chemical kraft pulps may make up the main pulp composition. This pulp has shorter fiber structure (0.3-0.6 mm) than soft wood, which contribute to good formation of the finished paper. Fillers may also be incorporated into the pulp, for example, to substantially control physical properties of the final coated paper. The filler particles fill in the void spaces of the fiber network and result in a denser, smoother, brighter, and opaque sheet. It can also significantly reduce the cost, as filler is generally cheaper than pulp. Examples of the fillers include, but are not limited to, ground calcium carbonate, precipitated calcium carbonate, titanium dioxide, kaolin clay, silicates, plastic pigment, alumina trihydrate, and/or mixtures thereof. It is to be understood that any desirable amount of filler, such as 15%, may be used. In one exemplary embodiment, the amount of filler ranges from about 0.1 wt. % to about 20 wt. % of the substrate, and in another embodiment, the amount of filler ranges from about 5 wt. % to about 15 wt. % of the substrate.

In preparation of the paper base stock, internal and surface sizing may be desired. This process may advantageously improve internal bond strength of the substrate fibers, and may also advantageously control the resistance of the coated substrate to wetting, penetration, and absorption of aqueous liquids. Internal sizing may be accomplished by adding a sizing agent to the substrate in the wet end. Non-limitative examples of suitable sizing agents include rosin-based sizing agent(s), wax-based sizing agent(s), cellulose-reactive sizing agent(s) and other synthetic sizing agent(s), and/or mixtures. It is to be understood that the type and amount of surface sizing agent(s) may substantially improve moisture resistance and may alter the stiffness of the base paper stock. Surface sizing (i.e. apply sizing agent to the formatted paper roll) may be accomplished by film size press, pond size press and other surface techniques. Included in this wet end processing can be additional functional additives such as but not limited to dispersants, biocides, retention aids, defoamers, dyes, anionic trash, and optical brighteners.

The paper substrate (101) may have a weight of 100 to 300 grams/meter$^2$ (gsm), and preferably have a base weight of 150 to 220 gsm. Since the stiffness of the paper stock may be related, at least in part, to the paper thickness, or paper weight, it is to be understood that with substantially the same pulp and filler composition, the thinner the paper caliper is, the lower the paper stiffness will be. If base weight is less than 100 gsm, low flexural rigidity may generate a higher jam rate. Customers also have lower acceptance for such a light weight paper as photographic print-out. However, if base weight is over 300 gsm, many printers can not support such high stiffness media. A method such as TAPPI T489OM-92, using a Taber-type stiffness tester, may be used to determine the stiffness of the paper stock. In one exemplary embodiment, stiffness ranges from about 800 Gurley stiffness units to about 2000 Gurley stiffness units in the paper machine direction, and ranging from about 400 Gurley stiffness units and about 1200 Gurley stiffness units in the paper cross machine direction. In another embodiment, the base paper stiffness ranges from about 800 Gurley stiffness units to about 1500 Gurley stiffness units in the paper machine direction, and from about 600 Gurley stiffness units to about 1000 Gurley stiffness units in the paper cross machine direction.

On either or both sides of the substrate (101) is the pigmented pre-coating (102). This pre-coating (102) may include multiple sub-layers as best suits a particular application. The function of the pigmented pre-coating (102) is to create a smooth surface to help develop superior gloss. Additionally, the pigmented pre-coating or layers (102) promote improved opacity, brightness, and appropriate color hue for the print medium.

Figure 3:
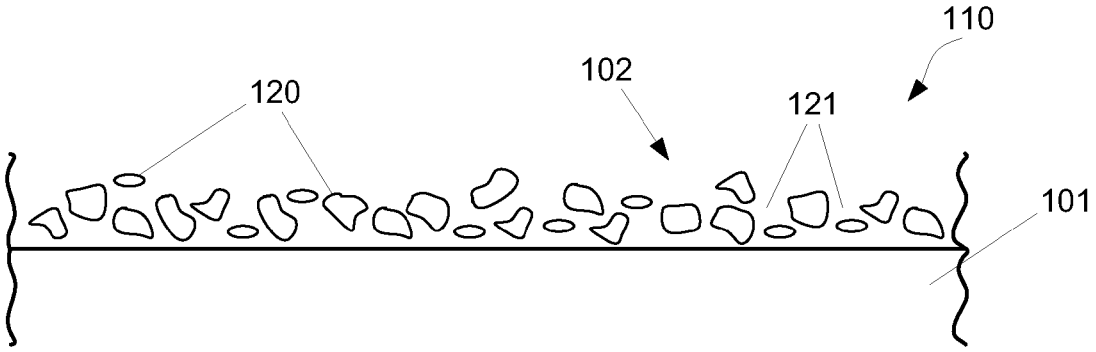
FIG. 3 illustrates a detailed view of a pigmented layer on a photographic printing paper according to principles described herein.

Referring to FIG. 3, a pigmented pre-coating (102) is made, for example, of at least one inorganic pigment (120) and at least one polymeric binder (121). The pigmented pre-coating (102) may also include any of the variety of coating additives known in the art that improve the appearance or functionality of photographic printing paper.

The inorganic pigment or substance (120) used may be prepared in powder or slurry form before being mixed with the binder for coating on the substrate (101). Examples of the inorganic pigments that may be used in the sub-layer (102) include, but are not limited to, titanium dioxide, hydrated alumina, calcium carbonate, barium sulfate, silica, high brightness alumina silicates, boehmite, pseudoboehmite, zinc oxide, kaolin clays, and/or their combination. The particle size of inorganic pigments may range from 0.2 to 1.5 micrometer and preferably in a range of 0.5 to 1.0 micrometer.

In another exemplary embodiment, co-pigments may be used in conjunction with inorganic pigments to promote the sheet's opacity, smoothness, and glossiness. Specifically, according to one exemplary embodiment, the co-pigments may be synthetic organic polymers such as hollow sphere emulsions, porous hollow plastic pigments, and solid spherical plastic pigments. The synthetic organic polymers may have a uniform particle size from 0.2 to 1.0 micrometer, and the amount used in the formulations may range from 1 part by dry weight to 10 parts by weight organic polymer to 100 parts by dry weight of inorganic pigments. More preferably, from 3 parts to 5 parts per 100 parts of inorganic pigments.

The binder (121) supplies an adhesion force between the base substrate (101) and the pigment particles (120), as well as binding pigment particles to each other. The binder (121) may be selected from the group of water soluble binders and water dispersible polymers which exhibit high binding power for base paper stock and pigments, either alone or as a combination. Suitable binders include, but are not limited to, water soluble polymers such as polyvinyl alcohol, starch derivatives, gelatin, cellulose derivatives, acrylamide polymers, and water dispersible polymers such as acrylic polymers or copolymers, vinyl acetate latex, polyesters, vinylidene chloride latex, syrene-butadiene or acrylonitrile-butadiene copolymers.

The inorganic pigment (102) and binder (121) may be used in the following proportions or effective amounts; from 5 to 15 parts by dry weight of binder to 100 parts by dry weight of inorganic pigments. In some examples, 8 to 10 parts binder are used relative to the 100 parts of pigment.

Returning to FIGS. 1 and 2, the back support layer (104) will now be described. The back support layer (104) may comprise a filler material(s) in a polymer binder. The filler material(s) may include inorganic pigment particles. The inorganic pigment or material may be, for example, calcium carbonate and kaolin clay particles. The filler material may also include polymer particles that are, in some examples, larger than the inorganic pigment particles in the back support layer (104). The polymer particles may include, for example, polyethylene beads. These particles are adhered to the substrate (101) and to each other by the action of a polymer binder. The back support layer (104) may also include a friction-reducing or slipping agent such as polymeric wax and/or other coating additives.

One function of the back support layer (104) is to give the photographic print medium feel that is similar to a traditional silver halide photograph. Another function of the back support layer (104) is to control the friction between sheets of the photographic printing paper so that the pick-up roller or sheet feeding mechanism of, for example, an inkjet printing system, can reliably pull individual sheets of the photographic printing paper into the printing system for reproducing photographs thereon. Still further, the back support layer may also function as a "blocking" layer so that in a continuous printing process, the imaged side of previous sheets will not stick together with back side of the sheets next to them.

The back support layer (104) also serves to compensate for the presence of the barrier layer (103) and the image-receiving layer (105) on the other side of the base substrate (101). The back support layer (104) balances internal stress in the substrate (101) so that curling of the substrate is minimized.

As described above, photographic printing base paper stock has traditionally been manufactured using an extrusion process in which a molten coating was extruded onto the base paper. In contrast, the photographic paper described herein can be produced without any extrusion process. Rather, the coating methods used to form the barrier layer (103), as well as the pigmented pre-coating (102) and the back support layer (104), may include, but are not limited to blade coating processes, rod coating processes, air-knife coating processes, curtain coating processes, slot coating processes, jet coating processing or any combination thereof.

Figure 4:
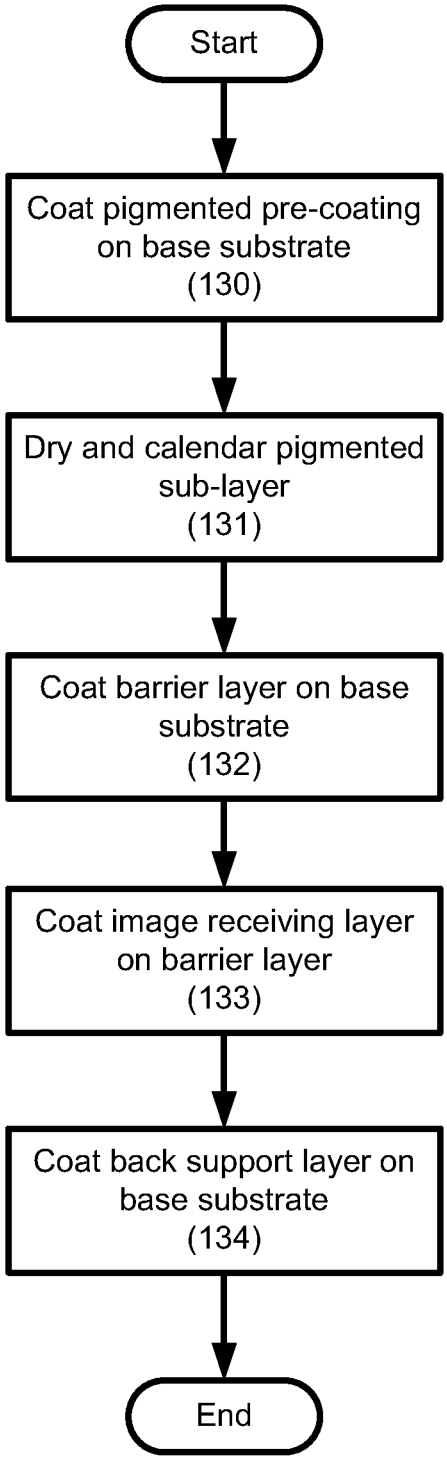
FIG. 4 is a flowchart illustrating an exemplary method of making photographic printing paper according to principles described herein.

FIG. 4 is a flowchart illustrating an exemplary method of making photographic printing paper according to principles described herein. As will be understood by those of skill in the art, the steps shown in FIG. 4 may be altered, modified or reordered as best suits a particular application.

The pigmented pre-coating(s) (102) can be applied in one or more layers simultaneously (step 130), with a coating weight of 5 to 30 grams/meter$^2$. In some examples, the coating weight of the pigmented pre-coating(s) (102) is from 10 to 15 grams/meter$^2$ for each coating layer on each side of the base substrate (101). In other examples, the solids content of each of the coating compositions can range from 60 to 75 percent by weight (wt %) with a viscosity of 1000 to 1500 centipoise (cps) as measured by a low shear Brookfield viscometer at a speed of 100 revolutions per minute (rpm), or 30 cps to 40 cps at a higher shear rate of 4500 rpm using a high shear Hercules viscometer.

After application, the pigmented pre-coating(s) (102) can be dried (step 131). Drying can be performed by any suitable means, including, but not limited to, convection, conduction, infrared radiation, atmospheric exposure, or other known method.

A calendering process can then be used to achieve the desired gloss or surface smoothness (step 131). In paper manufacturing, calendering is the process of smoothing the surface of the paper by pressing it between rollers. Supercalendering is calendering in a calender unit in which nips are formed between a smooth-surface press roll, such as a metal roll, and a roll covered with a resilient cover, such as a polymer roll. The resilient-surface roll adapts itself to the contours of the surface of paper and presses the opposite side of paper evenly against the smooth-surface press roll.

Any of a number of calendering devices and methods can be used. The calendering device can be a separate supercalendering machine, an on-line calendaring unit, an off-line soft nip calendaring machine, or the like. Some calendering systems do not require the paper to be as completely dried as other forms of calendering.

According to one exemplary embodiment, the calendering is carried out at a temperature ranged from 50 to 150° C. (metal roll surface temperature) and more preferably at 80 to 110° C. According to one exemplary embodiment, the nip pressure can be any value between 100 to 500 KN/cm$^2$ The surface smoothness of photographic printing base stock paper is an important factor in the quality of the paper and photographic images printed thereon. According to the method described above, a photographic printing base stock with high smoothness and glossiness can be made at effectively low cost, as long as the pigmented sub layer sheets have a minimum smoothness and glossiness level. It is desirable to have a surface smoothness, after sub-pigmented layers being coated, ranging from 2.5 to 5.0 Sheffield units, as measured by a Hagerty smoothness tester, Model 538.

Next, the barrier layer (103) is formed (step 132). The barrier layer (103) of the photographic printing paper (100, 110) comprises, for example, an organic coating layer with a coat weight of 1 to 30 grams/meter$^2$. In some examples, the coat weight of the barrier layer (103) is 2 to 15 grams/meter$^2$. In other examples, the coat weight of the barrier layer (103) is 3 to 6 grams/meter$^2$.

This layer (103) can be formed using any non-polyolefin polymeric materials which have good film-forming properties and produce a non-absorbing layer with smooth high-gloss appearance. Examples include, but are not limited to, water-soluble polymers, water dispersible polymers, and/or combinations thereof. More specific examples include, but are not limited to, acrylic resins, polyester resins, polycarbonate resins, polyacetal resins, poly vinyl acetate resins, polyether resin, polyurethane resins, and polyepoxide resins. According to one exemplary embodiment, the barrier layer is made of polyurethane, acrylic, and polyester resins. The polyurethane resin includes all kinds of water dispersible linear or cyclic polyurethanes and polyisocyanates. Acrylic resins may include polyacrylic acids and their ester, polymethyacrylic acids and their ester, and the copolymer of polyacrylonitrile-acrylates. Some examples of this type of polymers are polymethyl acrylate, polyethyl acrylate, polybutyl acrylate, polyhexyl acrylate, poly-n-octyl acrylate, poly-2-ethylhexyl acrylate, polybenzyl acrylate, polynonyl acrylate, polylauryl acrylate, polymethyl methacrylate, polyethyl methacrylate, polybutyl methacrylate, polyhexyl methacrylate, poly-n-octyl methacrylate, poly-2-ethylhexyl methacrylate, polybenzyl methacrylate, polynonyl methacrylate, polylauryl methacrylate, and acrylonitrileacrylates-styrene copolymers. Examples of polyester resins include the condensation polymer of the following acids with different alcohols: phthalic acids, azelaic acids, maleic acids, succinic acids fumaric acids, citraconic acids, itaconic acids, glutaconic acids, adipic acids, terephthalic acids, iso-phthalic acids, malonic acids, n-dodecenylsuccinic acids, iso-dodecenylsuccinic acids, n-dodecylsuccinic acids, iso-dodecylsuccinic acids, n-octenylsuccinic acids, iso-octenylsuccinic acids, n-octylsuccinic acids, iso-octylsuccinic acids, and anhydrides of these acids.

According to one exemplary embodiment, the glass transition temperature(s) of the barrier layer (103) are maintained in the range of 10-90° C., and preferably in the range of 30-60° C. If the glass transition temperature(s) of the barrier layer (103) are lower than approximately 10° C., the barrier layer will be sticky and gloss level will reduce. However, if glass transition temperature(s) exceed 90° C., the adhesion strength will scarify and likely generate micro-cracks on the surface.

In another exemplary embodiment, the barrier layer may contain some pigments to promote image responses such as whiteness, brightness, and sharpness. Example of pigments include, but are in no way limited to, ground calcium carbonate, precipitated calcium carbonate, zinc oxide, titanium dioxide, barium sulfate, magnesium carbonate, and kaolin clay. According to one exemplary embodiment, titanium dioxide is used in an amount of 8-15% by weight of polymeric resins in barrier layer. The titanium dioxide may be either rutile or anatase, or a combination of the two to promote both whiteness and image sharpness.

After the barrier layer is formed, an image-receiving layer (105) is formed (step 133) over the barrier layer (103). The image-receiving layer (105) may be formed on only one side of the photographic printing paper, or both sides as described in FIG. 2 without applying a back supporting layer (104).

According to one exemplary embodiment, the image receiving layer (105) comprises inorganic fine particles, a polymeric binder, and other functional additives such as ink fixatives. The inorganic fine particles can be any kind of white inorganic pigments but preferably those inorganic pigments with a plurality of pore structures to provide a high degree of absorption capacity for liquid ink vehicles via capillary action. Examples of such pigments include, but are in no way limited to, synthesized amorphous silica, colloidal silica, alumina, colloidal alumina, and pseudoboehmite (aluminum oxide/hydroxide). The inorganic pigments described above may be utilized as primary particles as they are, or in a state of forming secondary condensed particles. The binder can be any kind of water soluble or water dispersible polymers such as polyvinyl alcohol, polyvinylpyrrolidone, methyl cellulose, hydroxypropylmethyl cellulose, gelatin, polyethylene oxide, acryl-based polymer, polyester, polyurethane, and/or quaternary ammonium type copolymer.

Additionally, the back support layer (104) is formed on the base substrate (101) (step 134). Again, as noted above, the various layers described may be formed in a different order than illustrated in FIG. 4. For example, the back support layer may be formed before the barrier layer.

Figure 5:
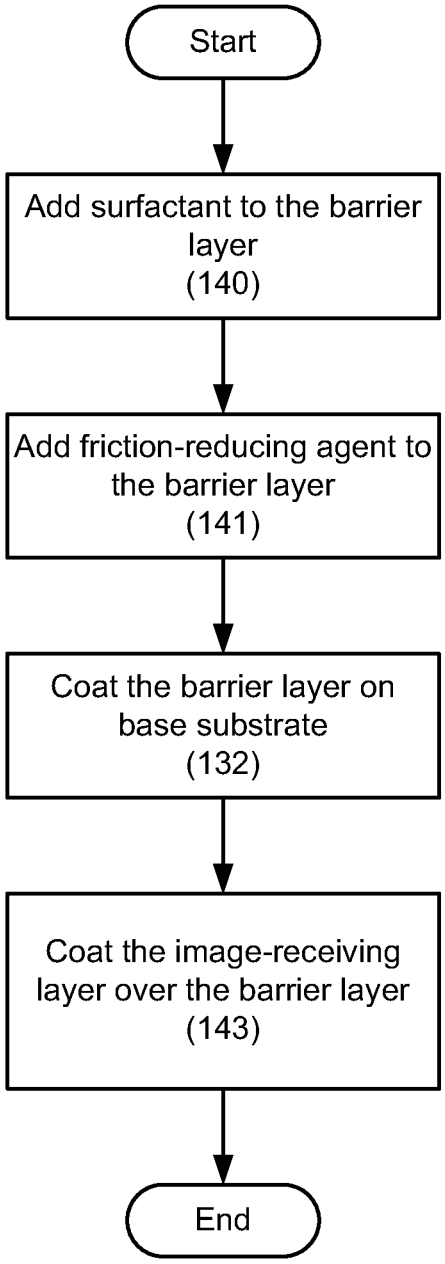
FIG. 5 is a flowchart illustrating an exemplary method of preparing the barrier layer on photographic printing paper according to principles described herein.

FIG. 5 is a flowchart illustrating in additional detail an exemplary method of preparing the barrier layer on photographic printing paper according to principles described herein. As will be understood by those of skill in the art, the steps shown in FIG. 5 may be altered, modified or reordered as best suits a particular application.

As noted above and shown in FIG. 5, the image-receiving layer (105) is formed over the barrier layer (103) (step 143). The image-receiving layer (105) is specifically formulated to interact with the ink, perhaps being tailored to specific ink compositions, to improve the quality of the printed image. Various compositions for such an image-receiving layer are known generally in the art or will be apparent to those of skill in the art given a particular ink composition and the principles described herein.

To be more compatible with the image-receiving layer (105), some additives may be included in the barrier layer (103) such as surfactant, slip or friction-reduction agent, and coating rheology control agents. Thus, as shown in FIG. 5, a surfactant may be added to the barrier layer (step 140) and a friction-reducing agent may be added to the barrier layer (step 141). The surfactant can be any suitable anionic, nonionic, or cationic surfactant. The amount of surfactant used in the barrier layer may be, according to one exemplary embodiment, between approximately 0.1 and 1%, and preferably, between approximately 0.2 and 0.5% by weight of total weight of polymeric resins. In some examples, the surfactant is a nonionic organosilicone compound, such as, but not limited to, a copolymer of polysiloxane-polyethylene oxide or terpolymer of polysiloxane-polyethylene oxide (propylene oxide), and ethylene oxide/propylene oxide diblock and triblock copolymers. In other examples the surfactant is an anionic surfactant such as, but in no way limited to, phosphate esters, sulfates and sulfonates of ethoxylated alkylphenols, sulfates and sulfonates of fluorosurfactants, alkylaryl sulfonates, diphenylsulfonate derivatives, sulfates and sulfonates of oils and fatty acids, sulfates of alcohols, sulfates of ethoxylated alcohols, sulfates of fatty esters, and sulfonates of condensed naphthalenes.

The slip or friction-reduction agent may be a wax. Any number of waxes can be used including both natural and synthetic waxes. The natural waxes include, but are in no way limited to, vegetable oil wax such as castor oil and carnauba waxes, and mineral waxes such as montan and ceresin waxes. The synthetic waxes may include, but are in no way limited to, petroleum waxes such as paraffin waxes and microcrystalline waxes, and polymeric waxes such as polyethylene and polytetrafluoroethylene waxes, and/or combinations thereof. The wax may be provided in a physical form comprising polymeric emulsions, polymer dispersions, or combinations thereof. The amount of waxes used in the barrier layer can range, according to one exemplary embodiment, from 0.5 to 5 dry parts by weight per 100 parts of polymeric resins. More particularly, according to one exemplary embodiment, the amount of waxes used in the barrier layer can range from 0.8 to 3 parts per 100 parts of polymeric resins.

While above examples of resins, inorganic pigments, surfactants and waxes form a major composition of the barrier layer, it is understood that this layer may also comprise other functional additives, for instance, single or mixture of dyes, optical brightness agents, UV absorbers, thickeners, defoamers, and the like.

Like the pigmented pre-coating(s) (102) and the back support layer (104) described above, the barrier layer (103) can be formed (step 132) by coating the barrier layer material on the photographic printing paper without using an extrusion process. A variety of coating methods may be used including, but not limited to, blade coating processes, rod coating processes, air-knife coating processes, curtain coating processes, slot coating processes, jet coating processing or combinations thereof.

Figure 6:
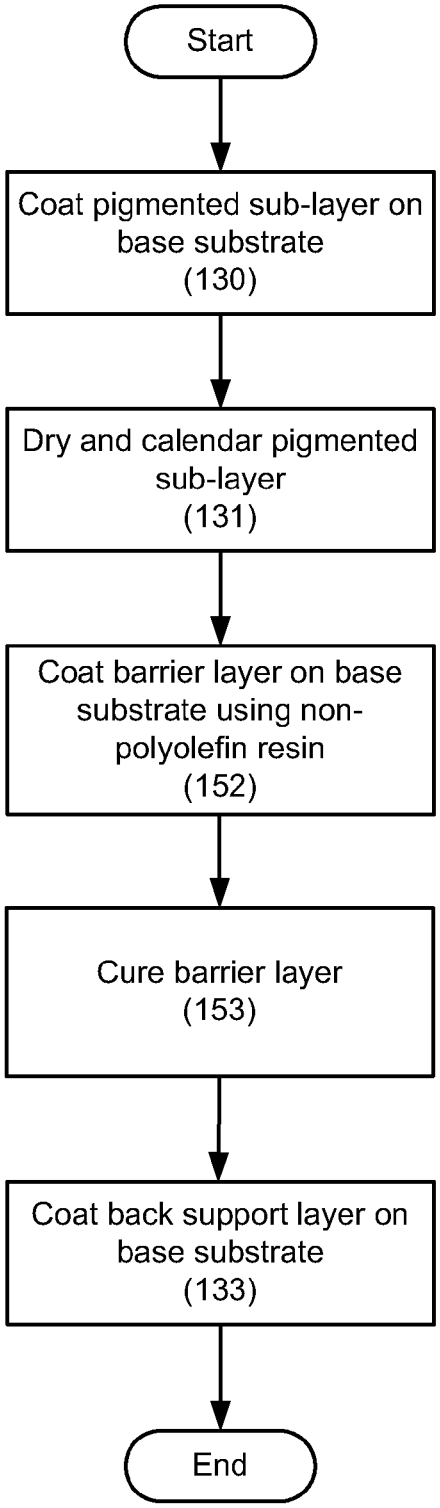
FIG. 6 is a flowchart illustrating another exemplary method of making photographic printing paper according to principles described herein.

In other examples, the barrier layer (103) can be made of organic monomers (both water/solvent soluble or 100% solids in low viscosity form) which can be cured by photo-initiation polymerization. FIG. 6 is a flowchart illustrating another exemplary method of making photographic printing paper according to these principles. As will be understood by those of skill in the art, the steps shown in FIG. 6 may be altered, modified or reordered as best suits a particular application.

Some of the steps of FIG. 6 are similar to those described in connection with FIG. 4. A pigmented pre-coating may be applied (step 130) and dried and calendared (step 131).

The barrier layer is then formed on the base substrate using a non-aqueous resin (step 152). Example of these resins include, but are not limited to, unsaturated polyesters, urethanes, acrylated resins, cyclic ethers, cyclic formals and acetals, sulfur or vinyl contained monomers, mono and/or difunctional epoxies, and epoxy pre-polymers.

The barrier layer is then cured using photo-initiation (step 153). This photo-initiation may be conducted according to a variety of methods including, but not limited to, photo-induced radical polymerization, photo-induced cationic ring-opening polymerization and photo-induced anionic polymerization.

The coating formulation described herein contains, for example, 1 to 10 parts of photo-initiator for every 100 parts of monomer or oligomer with viscosity of 50 to 300 cps. In some examples, the formulation includes 1 to 5 parts of photo-initiator for every 100 parts of monomer or oligomer. The formulation may also contain about 1 to 5 parts of ultraviolet light stabilizer. The coating can be applied by the methods indicated above that are compatible with non-aqueous coatings and cured under an ultraviolet light in air.

After being coated with the barrier layer, examples of the photographic base paper stock described herein provide Parker Print-Surface (PPS) ranges from 0.3 to 0.6 microns, as measured by TAPPI T555om-99 method and an excellent gloss level of 45 to 60%, as measured at 20 degrees, and a surface tension value ranging from 35 to 45 dynes/cm.

The preceding description has been presented only to illustrate and describe embodiments of the present exemplary system and method. It is not intended to be exhaustive or to limit the exemplary system and method to any precise form disclosed. Many modifications and variations are possible in light of the above teaching.

What is claimed is:

1. A method of making a photographic printing paper comprising:

forming a liquid coating composition comprising:

a non-ionic surfactant; and a water soluble or water dispersible non-polyolefin resin;

coating a paper base substrate with the liquid coating composition via a non-extrusion coating method to form a non-absorbing barrier layer; and depositing an image-receiving layer on an upper surface of the non-absorbing barrier layer.

2. The method of claim 1, in which the non-polyolefin resin is water soluble and an amount of the non-ionic surfactant comprises between 0.1 and 1% by weight of the total weight of the non-polyolefin resin.

3. The method of claim 2, in which the non-ionic surfactant comprises an organosilicone compound.

4. The method of claim 1, in which the barrier layer comprises a glass transition temperature between 10° C. and 90° C.

5. The method of claim 1, in which the barrier layer comprises a glass transition temperature between 30° C. and 60° C.

6. The method of claim 1, in which the non-polyolefin resin comprises one of an acrylic resin, a polyacetal resin, a poly vinyl acetate resin, a polyether resin, a polyurethane resin, or a polyepoxide resin.

7. The method of claim 1, in which coating the non-absorbing barrier layer comprises a blade coating process, a rod coating process, an air-knife coating process, a curtain coating process, a slot coating process, a jet coating process, or combinations thereof.

8. The method of claim 1, further comprising coating a pigmented pre-coating on the base substrate before applying the barrier layer on the base substrate over the pigmented pre-coating.

9. The method of claim 8, further comprising drying the pigmented pre-coating prior to applying the barrier layer.

10. The method of claim 9, further comprising performing a calendaring process prior to applying the barrier layer.

11. The method of claim 1, further comprising coating a back support layer on the base substrate on a side of the base substrate opposite the image-receiving layer.

12. A method of making a photographic printing paper comprising:

forming a liquid coating composition comprising:

a non-ionic organosilicone surfactant; and a water soluble or water dispersible non-polyolefin resin, in which an amount of the non-ionic organosilicone surfactant comprises between 0.1 and 1% by weight of the total weight of the non-polyolefin resin;

coating both sides of a paper base substrate via a non-extrusion liquid coating method to form a non-absorbing barrier layer; and depositing image-receiving layers over and adjoining the barrier layers on both sides of the paper base substrate.

* * * * *

UNITED STATES PATENT AND TRADEMARK OFFICE

CERTIFICATE OF CORRECTION

PATENT NO. : 8,709,546 B2
APPLICATION NO. : 13/525084
DATED : April 29, 2014
INVENTOR(S) : Xiaoqi Zhou et al.

It is certified that error appears in the above-identified patent and that said Letters Patent is hereby corrected as shown below:

In the Claims

In column 11, line 18, in Claim 6, delete "non-polyolefin resin" and insert -- polymeric material --, therefor.

Signed and Sealed this
Twenty-third Day of September, 2014

Michelle K. Lee

Michelle K. Lee
*Deputy Director of the United States Patent and Trademark Office*